US007938355B2

(12) United States Patent
Benvenuti

(10) Patent No.: US 7,938,355 B2
(45) Date of Patent: May 10, 2011

(54) DEVICE AND METHOD FOR FEEDING PLIES OF WEB MATERIAL

(75) Inventor: Angelo Benvenuti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 883 days.

(21) Appl. No.: 11/889,248

(22) Filed: Aug. 10, 2007

(65) Prior Publication Data

US 2008/0035777 A1 Feb. 14, 2008

(30) Foreign Application Priority Data

Aug. 11, 2006 (IT) ..... FI2006A0205

(51) Int. Cl.
*B65H 18/08* (2006.01)

(52) U.S. Cl. ..... 242/530; 242/530.2; 242/615.11

(58) Field of Classification Search ..... 242/530, 242/530.2, 566, 615.11; 226/97.3
See application file for complete search history.

(56) References Cited

U.S. PATENT DOCUMENTS

| | | | | |
|---|---|---|---|---|
| 2,108,652 | A | | 2/1938 | Coanda |
| 3,795,166 | A | | 3/1974 | Brand |
| 3,999,696 | A | | 12/1976 | Reba et al. |
| 4,014,487 | A | | 3/1977 | Reba et al. |
| 4,074,841 | A | | 2/1978 | Kramer |
| 4,136,808 | A | | 1/1979 | Reba |
| 4,186,860 | A | | 2/1980 | Reba |
| 4,362,778 | A | | 12/1982 | Andersson et al. |
| 4,483,889 | A | | 11/1984 | Andersson |
| 4,843,731 | A | * | 7/1989 | Vits ..... 34/364 |
| 5,738,760 | A | | 4/1998 | Svanqvist et al. |
| 5,967,457 | A | | 10/1999 | Wildenberg et al. |
| 5,970,627 | A | | 10/1999 | Stenz et al. |
| 6,039,285 | A | | 3/2000 | Biagiotti |
| 6,325,896 | B1 | | 12/2001 | Hultcrantz et al. |
| 6,464,163 | B1 | | 10/2002 | Kinnunen et al. |
| 6,497,787 | B1 | | 12/2002 | Geel |
| 6,651,923 | B2 | | 11/2003 | Kinnunen et al. |
| 6,679,451 | B1 | | 1/2004 | Biagiotti |
| 6,843,200 | B2 | | 1/2005 | Kinnunen et al. |
| 2004/0251370 | A1 | | 12/2004 | Solberg et al. |
| 2006/0124229 | A1 | | 6/2006 | McNeil |

FOREIGN PATENT DOCUMENTS

| | | | |
|---|---|---|---|
| DE | 195 34 812 | A1 | 3/1997 |
| GB | 2 017 056 | A | 10/1979 |
| WO | WO 96/33120 | A1 | 10/1996 |
| WO | WO 03/035974 | A1 | 5/2003 |
| WO | WO 2004/080867 | A2 | 9/2004 |
| WO | WO 2004/080869 | A2 | 9/2004 |

OTHER PUBLICATIONS

Anonymous, "Low Velocity Airfoil", Research Disclosure, Mason Publications, Hampshire, Great Britain, vol. 434, No. 83, Jun. 2000, XP007126287.

* cited by examiner

*Primary Examiner* — Sang Kim
(74) *Attorney, Agent, or Firm* — Breiner & Breiner, L.L.C.

(57) ABSTRACT

The device includes a supporting surface, with an initial curved surface portion, and a substantially flat surface portion. Above the supporting surface, extends at least part of a first path and of a second path of a first ply and of a second ply. The two paths are disposed adjacent to the supporting surface and the initial curved surface portion has a convexity facing the first path. Also provided is a system to supply air between the first path of the first ply and the supporting surface, to help support the web material with respect to the supporting surface.

42 Claims, 8 Drawing Sheets

P
PM
0
V1
V2
V
C1
C2
C3

V1≡V3
61
61
61

V5≡V3≡V1
A
A
A
61
61
61
83
81
87
87
85
41B
91
93
95
97
99
101

DEVICE AND METHOD FOR FEEDING PLIES OF WEB MATERIAL

TECHNICAL FIELD

The present invention relates to improvements to systems and methods for feeding web materials, in particular paper and tissue paper, in converting lines.

More specifically, although not exclusively, the present invention relates to devices and methods to convey plies or sheets of web material from one or more unwinders towards a converting machine, for example to produce rolls of tissue paper, such as rolls of kitchen towels, toilet paper or similar, napkins or the like.

STATE OF THE ART

In the paper converting industry, and in particular for converting tissue paper, to produce rolls of toilet paper, kitchen towels, paper handkerchiefs and napkins or the like, there are used large reels of paper from paper mills and containing a single ply or several plies wound around the same axis. These reels of large diameter and high axial length, called parent reels, are unwound in unwinding devices to feed a converting line which normally comprises one or more processing stations. Typically from one or more unwinders several plies of tissue paper can be fed to embossing units, printing units, rewinding units to produce logs of paper with a diameter substantially smaller than the diameter of the reel and with an axial length the same as the axial length of the reel, i.e. as the width of the paper ply. These logs are then cut orthogonally to the axis thereof to form single rolls to be sent for packaging and for sale. Alternatively, the plies of tissue paper can be fed to folding machines to form packs of napkins or similar articles.

Many articles, both in roll and folded form, are constituted by more than one ply. The various plies that form the finished product can be fed from a single reel on which there are wound several plies, or more frequently from two or more reels, each of which can contain a single ply or several plies. In particular, when the plies of tissue paper must be subjected to processing operations that differ from ply to ply, for example different degrees of embossing, the use of different unwinders is required, as embossing changes the length of the web material, and therefore it would be impossible to feed the converting line with plies all coming from the same reel. In fact, in this case it is necessary to feed plies from separate reels which can be taken to a different unwinding speed from reel to reel.

When two or more plies must be fed towards converting machines downstream, these plies must be able to run with respect to a feed or processing surface without excessive friction and, in some cases, allowing a difference in speed between contiguous plies for the aforesaid reasons.

Examples of unwinders for use in tissue paper converting lines are described in WO-A-2004/080869, WO-A-2004/080867, WO-A-96/33120, U.S. Pat. No. 6,679,451 and others.

OBJECTS AND SUMMARY OF THE INVENTION

An object of an embodiment of the invention is to produce a device to feed plies of web material, for example but not exclusively to be combined with unwinders that feed tissue paper converting lines, which allows more efficient feed and improved control of the plies, less friction and the possibility of disposing more than two plies on adjacent paths with the plies superposed on one another, and possibly allowing the plies to be fed at different speeds.

According to a first aspect, the invention relates to a device to feed plies of web material, comprising a first path for a first web material and a second path for a second web material, at least partly superposed on each other. In the area of superposition the first and the second web material are adjacent to each other, preferably without mechanical elements separating the two paths. The device also comprises a supporting surface, above which the plies run, with a cushion of air between the lower ply and this surface. The supporting surface comprises an initial curved portion of surface, with a convexity facing the path of the ply above. Moreover, there is provided a compressed air supply system between the first path and the supporting surface, to help to support the web material with respect to the supporting surface.

In an advantageous embodiment, the curved portion of surface has an aerodynamic profile, typically a wing-shaped profile, which generates a suction of ambient air between the supporting surface and the first web material, as a result of the movement of the first web material with respect to the aerodynamic profile. In practice, the convex aerodynamic profile has a shape such that it gradually draws toward to the path of the web material starting from a point of maximum distance to a point of minimum distance in the direction of feed of the web material.

According to a preferred embodiment of the invention, the portion of supporting surface disposed downstream of the curved portion is substantially approximately flat and is substantially tangent to the curved portion of surface with aerodynamic profile. The substantially flat portion of surface can have a surface structure that is not smooth, for example provided with a series of protuberances and recesses disposed according to a particular design. According to an advantageous embodiment, this surface structure is produced with a sort of embossing with a rice grain pattern, i.e. with elongated protuberances (similar to the shape of a grain of rice) oriented with the greater dimension in the direction of feed of the web material. In this manner, there are formed on the surface raised areas and depressed areas, the latter defining a preferential passage for the air flow, while the ply tends to float grazing or above the protuberances, helped in this by the air flow that passes with greater ease in the recessed areas between adjacent protuberances.

According to an advantageous embodiment of the invention, along each path of the plies there are disposed respective guide rollers. Along the path of the first ply there can be provided, for example, a roller positioned approximately in the position in which the compressed air supply system is arranged.

One or more of the guide rollers can be adjustable to modify the distance of the path of the plies with respect to the supporting surface.

According to a preferred embodiment of the invention the conditions of the air flow through said compressed air supply system can be regulated. Regulation can, for example, be performed as a function of the feed speed of at least one of said plies of web material.

The conditions of the compressed air flow can be regulated to increase, reduce or interrupt the compressed air flow through the nozzles of the supply system.

According to a possible embodiment of the invention, the compressed air supply system comprises at least one laminar nozzle, i.e. a nozzle which generates an air blade or curtain. For example, the laminar nozzle can comprise a slot or a series of aligned slots for delivery of the compressed air, combined with at least one inclined surface to generate a suction of ambient air as a result of the compressed air flow delivered from said slot.

In particular, in the case of devices of considerable width, i.e. intended to process plies or web materials of large transverse dimension, several nozzles can be provided, which are aligned transverse to the direction of feed of the web material. Alignment can be approximately orthogonal to the direction of feed of the web material, for example with an inclination not exceeding 10° with respect to the direction orthogonal to the direction of feed.

In a particularly advantageous embodiment of the invention, there are provided two or more nozzles each connected to at least one supply duct of its own for compressed air or simply forced air, i.e. coming from a fan or blower, the supply ducts being independent, with independent regulation of the air flow to said nozzles. This allows only some of the nozzles to be opened, or different pressures and therefore different air flow rates to be obtained for the various nozzles. For this purpose, the supply ducts connected to the various nozzles can preferably be associated with respective pressure regulators to regulate the pressure of the compressed or forced air flow supplied to said nozzles.

The laminar nozzles can be Coanda effect nozzles, which generate a flow substantially tangent to the supporting surface. The Coanda effect nozzle or nozzles are disposed approximately between the portion of substantially flat surface and the portion of curved surface. The air delivery slot is advantageously oriented upward and downstream thereof, with respect to the direction of feed of the web material, there is provided a curved surface to which the air flow adheres. The curved surface is approximately tangent to the substantially flat portion of the supporting surface.

According to a possible embodiment of the invention, at least one of the paths of the plies or web materials has a substantially rectilinear inclined section with respect to the supporting surface, with an angle such that the path is divergent with respect to the supporting surface in the direction of feed of the web material along the respective path. An adjustable guide roller can be provided to adjust the inclination of the ply. Preferably, there is provided a common guide roller downstream, on which all the plies are guided and, for each ply, a guide roller upstream. Advantageously, all the guide rollers are adjustable in position. Alternatively, the roller downstream can be in a fixed position and the rollers upstream for the single paths of plies can be adjustable separately from one another.

In a preferred embodiment of the invention, along at least one of the paths of the web materials there is provided at least one tension sensor to detect the tension of the web material. Preferably, the sensor or the sensors are associated with a guide roller for the web material, preferably to the supports of the roller. Particularly advantageous is a configuration in which there is provided at least one tension sensor in each of the paths to detect the tension of each ply or web material.

In a possible embodiment of the invention, the compressed or forced air supply system is controlled so as to supply compressed or forced air when the speed of at least one of the web materials drops below a first threshold value and to interrupt the supply of compressed or forced air when the speed of at least one of said web materials exceeds a second threshold value.

As a rule, there can be provided a single supporting surface with a flat or substantially flat surface portion, upstream of which a wing-shaped profile is arranged, i.e. a curved surface with convexity facing the path of the ply or plies. In a preferred embodiment of the invention, however, several supporting surfaces are provided and arranged in succession under said first path of the first web material, a compressed air or forced air supply system being associated with at least one of said supporting surfaces. Preferably, the compressed or forced air is supplied to the second or successive supporting surface, while no compressed or forced air is supplied to the first supporting surface.

When there are provided several paths for several plies, for example three plies, along the supporting surface, or one of the supporting surfaces, and thereabove there is preferably disposed at least one compressed or forced air nozzle, advantageously a Coanda effect nozzle, adjacent to one of said paths, shaped and oriented so as to generate, by means of an air flow delivered therefrom, a lifting effect on the web material fed along said path. This nozzle is advisably a laminar nozzle in the sense indicated above, i.e. provided with a narrow and elongated slot, in a direction transverse to the direction of feed of the web material. For specific needs, for example for web material of considerable widths, advantageously several nozzles aligned transverse to the direction of feed are used.

In a preferred embodiment of the invention, the air nozzle placed over the path of the ply is positioned downstream of the air supply system.

According to a further aspect, the invention relates to a line for converting tissue paper, comprising at least one unwinder to unwind reels of web material, at least one converting machine and at least two paths for at least two web materials between said at least one unwinder and said at least one converting machine, wherein between said at least one unwinder and said at least one converting machine there is disposed a device as defined above. Preferably, the line comprises at least two unwinders in sequence, to simultaneously unwind two reels of web material, to feed at least a first web material and a second web material along a first and a second path respectively.

According to a further aspect, the invention relates to a method to feed at least two web materials along at least partially superposed paths, under which there extends a supporting surface with an initial curved portion with a convexity facing said superposed paths to generate a support of the web materials as a result of an ambient air flow drawn by suction between the web materials and the supporting surface; wherein by means of at least one air supply system compressed or forced air is supplied between said paths and said supporting surface to help to support the web material with respect to the supporting surface at least in specific conditions of movement of the web materials along said paths.

Further advantageous features and embodiments of the invention are described hereunder with reference to non-limiting embodiment of the invention.

BRIEF DESCRIPTION OF THE DRAWINGS

The invention will be better understood by following the description and the accompanying drawing, which shows a practical non-limiting embodiment of the invention. More specifically.

DETAILED DESCRIPTION OF EMBODIMENTS OF THE INVENTION

Figure 1:
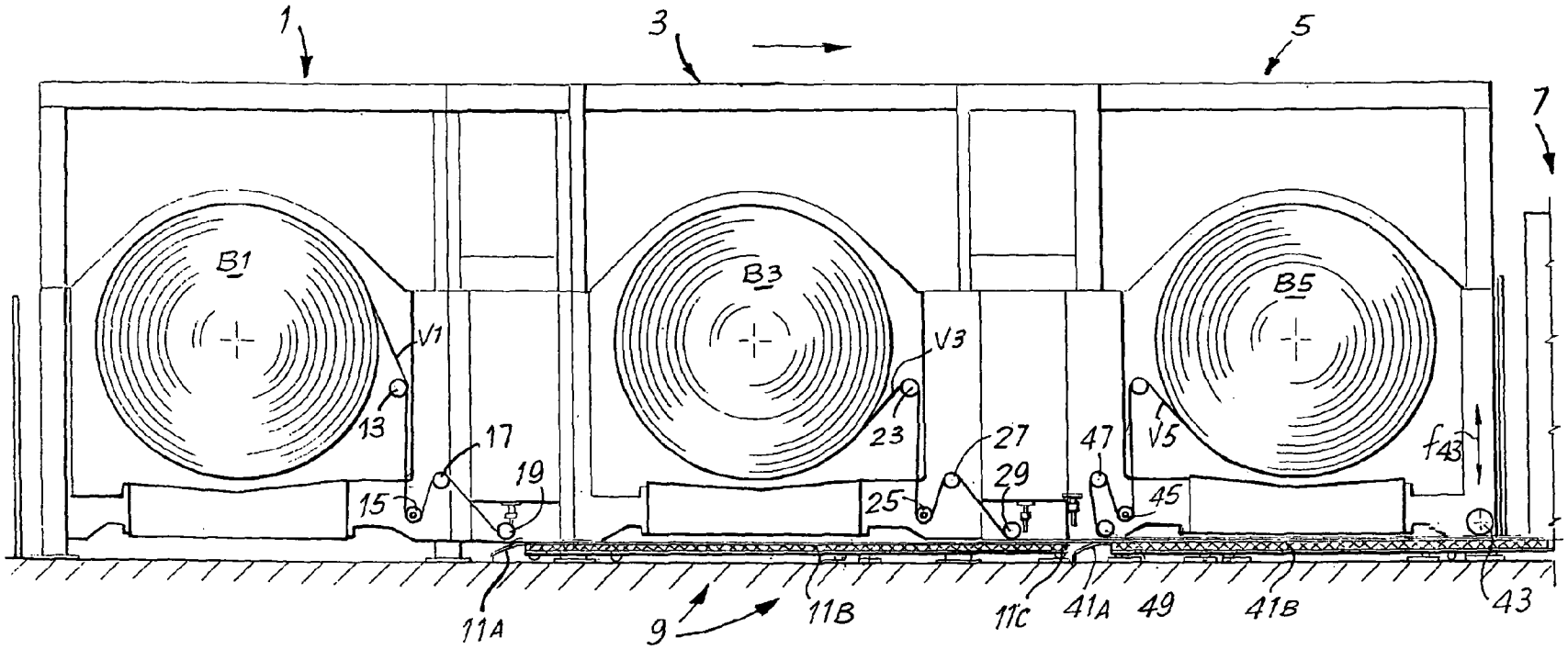
FIG. 1 shows a side view of a group of three unwinders to separately feed three plies to a converting line downstream.

FIG. 1 shows a portion of a tissue paper converting line, for example for producing rolls or toilet paper, kitchen towel or the like. In the diagram in FIG. 1 three unwinders in series are shown, indicated with 1, 3 and 5 and disposed upstream of a generic converting station or machine 7, which could be an embossing unit or the like.

B1, B3 and B5 indicate three reels of web material being unwound in the single unwinders 1, 3 and 5. V1, V3 and V5 indicate three single plies fed from the reels B1, B3 and B5. As mentioned above, it would also be possible for one or more of the unwinders to contain multiple reels, i.e. with more than one ply wound thereon.

Figure 2:
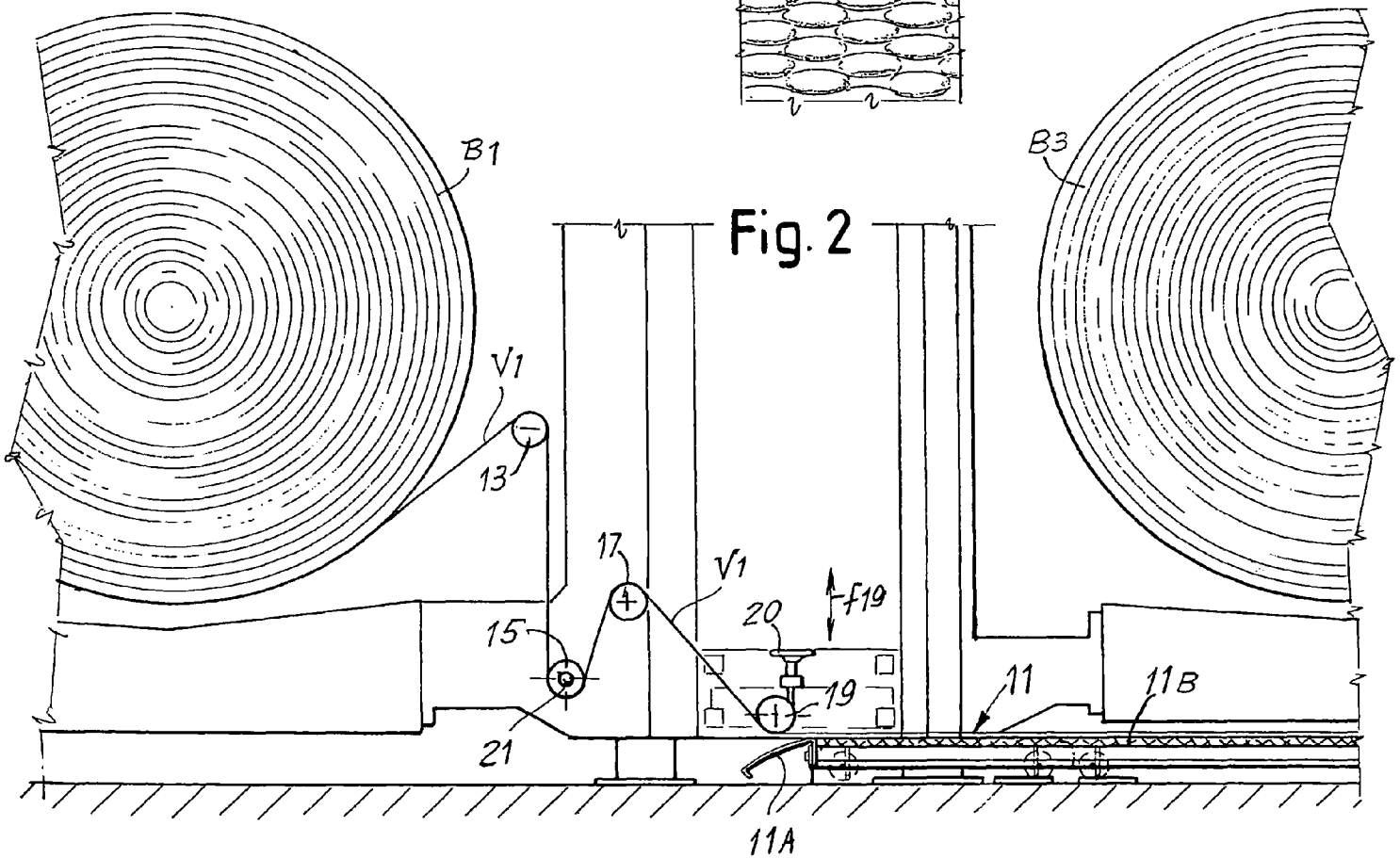
FIG. 2 shows an enlargement of the initial area of the path of the plies.
Figure 3:
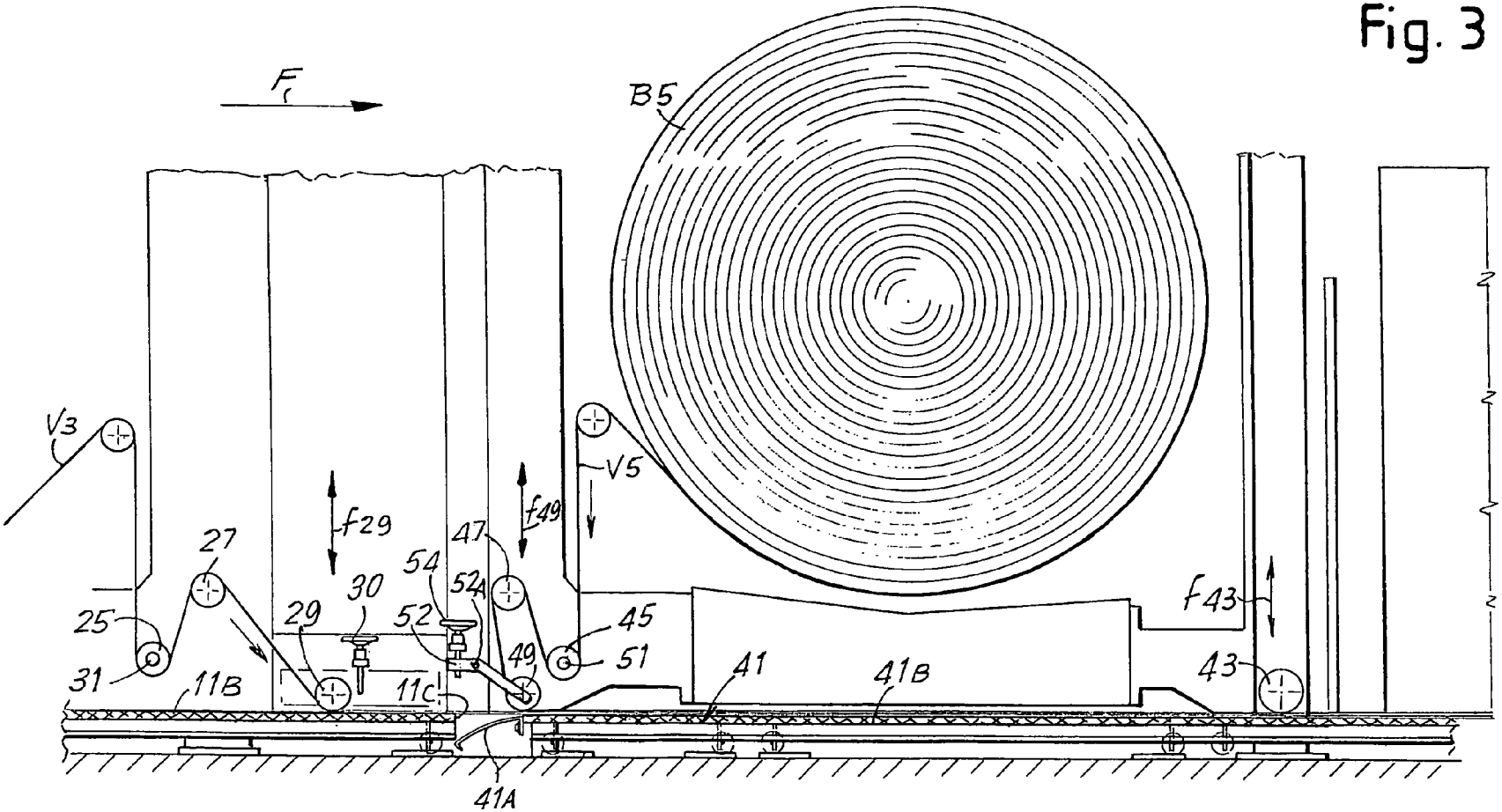
FIG. 3 shows an enlargement of a second area of the path of the plies.

Underneath the unwinders 1, 3 and 5 there are disposed members generically indicated with 9, which define three at least party superposed paths for the plies V1, V3 and V5 toward the station 7. FIGS. 2 and 3 show in greater detail two consecutive portions of the area of passage of the plies V1, V3 and V5.

More specifically, in the area adjacent to and under the reel B1 there is a first supporting or feed surface indicated with 11, comprising a first inlet portion 11A constituted by a wing-shaped or aerodynamic profile, i.e. by a curved surface with convexity facing the ply V1 coming from the reel B1. Downstream of the curved inlet portion 11A there is disposed the substantially flat and preferably horizontal portion 11B. The convex surface 11A is substantially smooth, while in a possible embodiment the substantially flat surface 11B is embossed with a "rice grain" pattern schematized in FIG. 2A, obtained for example by stamping a metal sheet forming the outermost layer of a multi-layer structure, for example made of plywood, defining the substantially flat portion of surface 11B. The structure of the surface 11B made of sheet metal and wood is particularly useful to obtain antistatic behavior.

Along the path of the ply V1 there is a first guide roller 13 adjacent to the reel B1 and a group of three rollers 15, 17 and 19, better shown in FIG. 2. The three rollers 15, 17 and 19 can be made of synthetic resin reinforced with carbon fiber or another particularly light material and are preferably idle. On the supports of the roller 15 load cells 21 or other measuring members are arranged, to detect the stress exerted by the ply V1 on the roller, and obtain therefrom the tension to which the ply V1 is subjected. The roller 17 is a simple guide roller with a fixed axis, while the roller 19 can be adjusted vertically according to the double arrow f19, for the purposes to be explained below. For this purpose there is provided an adjustment handwheel 20, which can be motorized.

The substantially flat portion 11B of the supporting surface 11 extends in the overall direction of feed of the ply materials V1, V3 and V5, represented by the arrow F toward the station 7 to a final end 11C disposed downstream of the area in which the path of the ply V1 is superposed by the path of the second ply V3 coming from the reel B3. The path of the ply V3 extends from a guide roller 23 to a group of three rollers 25, 27 and 29 substantially equivalent to the rollers 15, 17 and 19 and having shape and structure substantially the same as these. The numeral 30 indicates a handwheel (which can be motorized) to adjust the position of the axis of the roller 29.

Figure 2A:
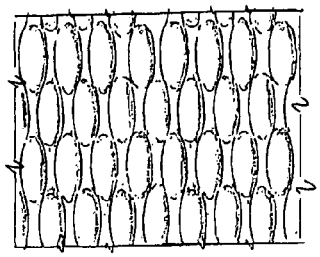
FIG. 2A shows a plan view of a portion of the flat surface on which the ply runs.

Downstream of the end 11C of the substantially flat portion of wall 11B there is disposed a second supporting surface indicated as a whole with 41 and comprising, similar to the surface 11, a first portion 41A having a convex curved shape with the convexity facing the ply V3, i.e. upward, and a second substantially flat portion 41B, the upper surface of which is embossed with a rice grain pattern similar to the one shown in FIG. 2A for the flat portion of surface 11B. Also in the case of the flat portion 41B, just as for the flat portion 11B, a structure comprising a sheet of embossed steel coupled with a wooden load bearing structure can be used to obtain an antistatic effect.

In a position of the path of the plies along the surface 41, above the latter and downstream of the convex profile 41A, there is disposed a guide roller 43, while approximately at the level of the profile constituted by the convex surface 41A and above the latter are three rollers 45, 47 and 49 with shape and structure substantially similar to the one of the rollers 25, 27 and 29 and 15, 17 and 19. The numeral 51 indicates schematically a load cell associated with one of the supports of the roller 45. The load cells associated with this roller detect the tension of the ply V5 similarly to the load cells 31 associated with the roller 25 for the ply V3. The roller 49 has a vertically adjustable axis according to the double arrow f49, similar to the roller 19 and the roller 29. In this case the mechanism comprises a lever 52 pivoting in 52A adjustable by a handwheel 54, which can also be motorized.

Figure 4:
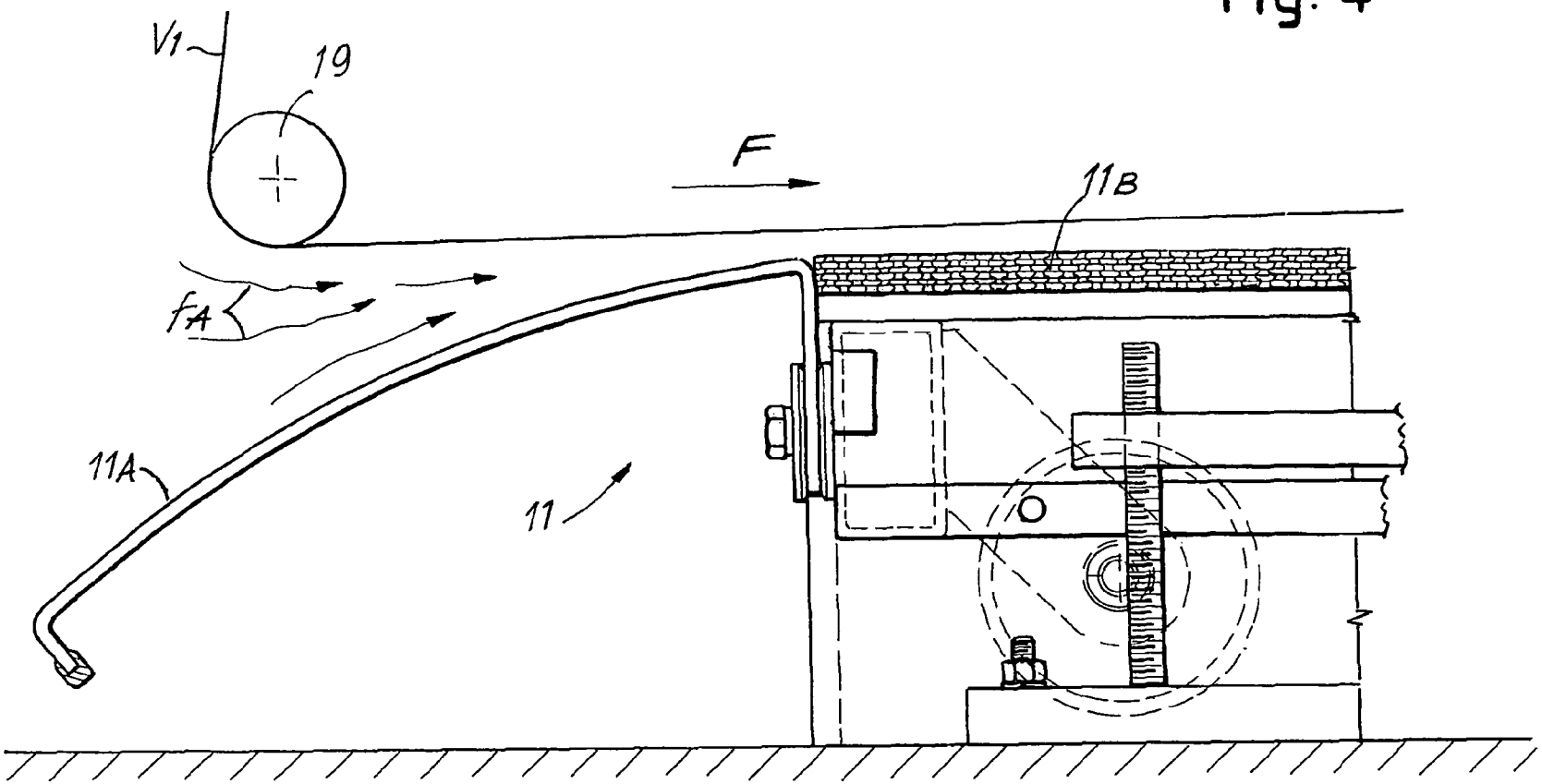
FIG. 4 shows the wing-shaped or aerodynamic inlet profile for the first ply.
Figure 5A:
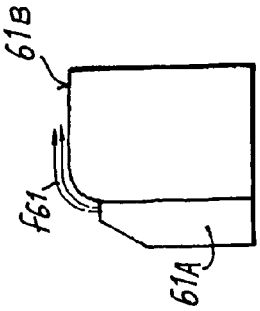
FIG. 5A shows an enlargement of a Coanda effect air nozzle.
Figure 5:
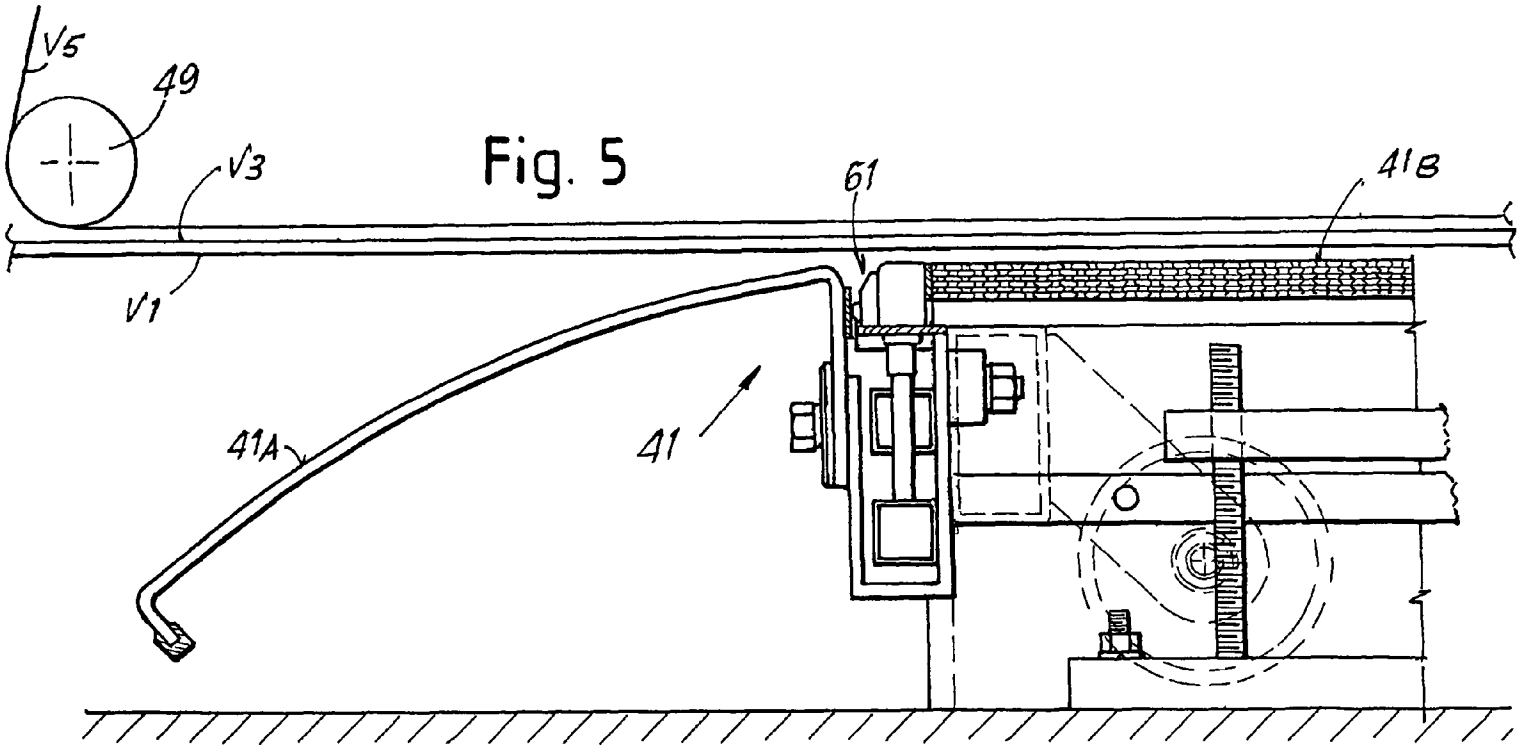
FIG. 5 shows the wing-shaped or aerodynamic inlet profile of the second section of the feed path of the plies in a first embodiment.

FIGS. 4 and 5 show in an enlarged detail the initial area of the supporting surfaces 11 and 41 respectively. More specifically, FIG. 4 shows the convex surface 11A constituted in substance by a wing-shaped profile disposed directly upstream of the substantially flat portion of surface 11B.

The movement of the ply V1 according to the arrow F above the convex surface 11A and almost tangent thereto causes suction of ambient air according to the arrows fA. As a result of the speed of the ply V1 the air is forced between it and the substantially flat portion of surface 11B, creating a cushion of air that contributes towards supporting the ply V1 over the substantially flat surface 11B. The embossing with rice grain pattern facilitates the formation and maintenance of a layer of air in this area which contributes towards making the moving ply V1 "float" above the surface, thereby reducing friction.

Through adjustment of the position of the axis of rotation of the roller 19 and of the roller 43, which define two points of a substantially rectilinear trajectory of the ply V1, it is possible to impart on the path of the ply V1 an inclination according to an angle such that the path of the ply tends to diverge with respect to the portion of surface 11B. This angle generates an aerodynamic upward thrust on the ply which contributes towards supporting it.

In the initial area of the supporting surface 41 (see FIG. 5), besides the convex portion of surface 41A forming a wing-shaped profile similar to the one formed by the convex surface 11A, and between said profile 41A and the substantially flat portion of surface 41B there is arranged a series of laminar nozzles 61. Laminar nozzles are intended as nozzles that generate a flow of air through an elongated slot 61A oriented in a direction substantially transverse and preferably orthogonal with respect to the direction of feed of the plies V1, V3 and V5. The air supplied to the nozzles can be supplied by a compressed air line, for example the main compressed air line of the plant, or by a fan or by a blower provided for this purpose. Compressed air is intended in general also as forced air, i.e. supplied with a very small overpressure with respect to the ambient pressure.

Adjacent to the slots 61A of the nozzles 61 there is provided a curved surface 61B preferably constituted by a ruled surface with generatrices parallel to the slot 61A. This nozzle generates an air flow that adheres, through the Coanda effect, to the curved surface 61B as represented schematically by the arrows f61 indicated in the enlargement in FIG. 5A.

Laminar nozzles of this type are known per se. They are produced and marketed, for example, with the trade name "FULL-FLOW AIR KNIFE" by Exair Corp. Cincinnati (Ohio, USA).

The flow of air delivered from the laminar nozzle in turn draws in air from the surrounding environment, so that with relatively low compressed air flow rates a higher air flow is obtained downstream of the nozzle, which is forced between the substantially flat portion of surface 41B and the plies above.

As can be observed in FIG. 5, the surface 61B of the laminar nozzles 61 is substantially tangent to the substantially flat surface 41B, so that with the aid of these nozzles 61 a substantial cushion of air is formed, even when the speed of the plies V1, V3 and V5 is limited and thus insufficient to produce adequate drawing of air.

Figure 6:
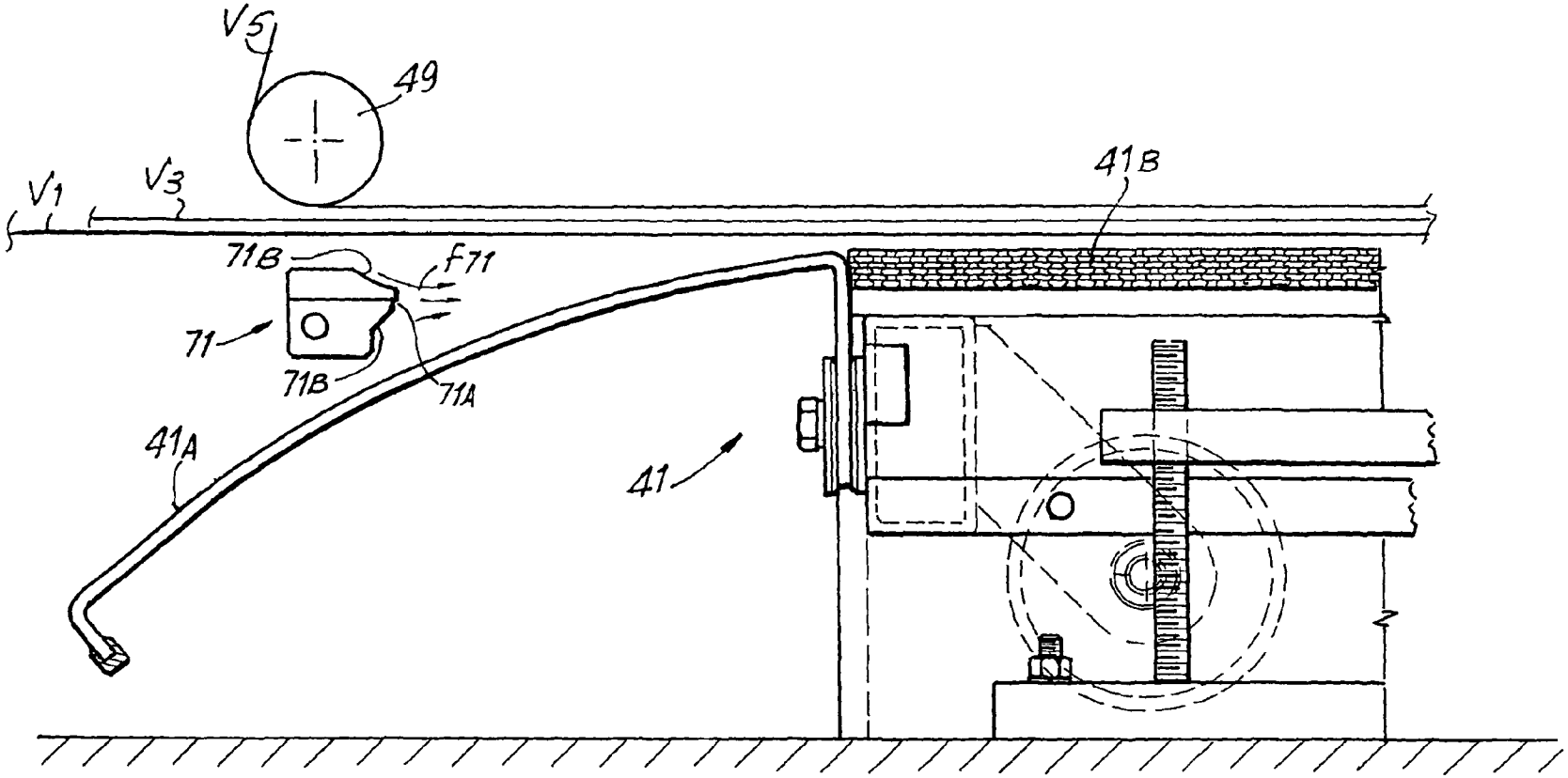
FIG. 6 shows a variant of embodiment of the area of the second wing-shaped profile.

FIG. 6 shows a modified embodiment of this portion of the device, with the use of a different type of laminar nozzles. The same numbers indicate the same or equivalent parts to those in FIG. 5. The laminar nozzles are in this case indicated with 71, while 71A indicates the longitudinal slot, disposed transversely with respect to the direction of feed of the plies V1, V3 and V5, from which the compressed air flow is delivered. At the sides of the slot 71A there are disposed surfaces 71B, along which a flow of ambient air, represented by the arrows f71, is created by suction. Therefore, also in this case, as a result of suction of the surrounding ambient air, the compressed air delivered from the slot 71A of the laminar nozzles 71 generates an air flow, which is forced between the surface 41A, 41B and the ply V1, with a substantially higher flow rate with respect to the flow rate of compressed air through the nozzles 71.

Nozzles of the type indicated with 71 are also known per se. A type of nozzle that can be used in this application is produced and distributed by Exair Corp. with the name of "FULL-FLOW AIR KNIFE".

Figure 7:
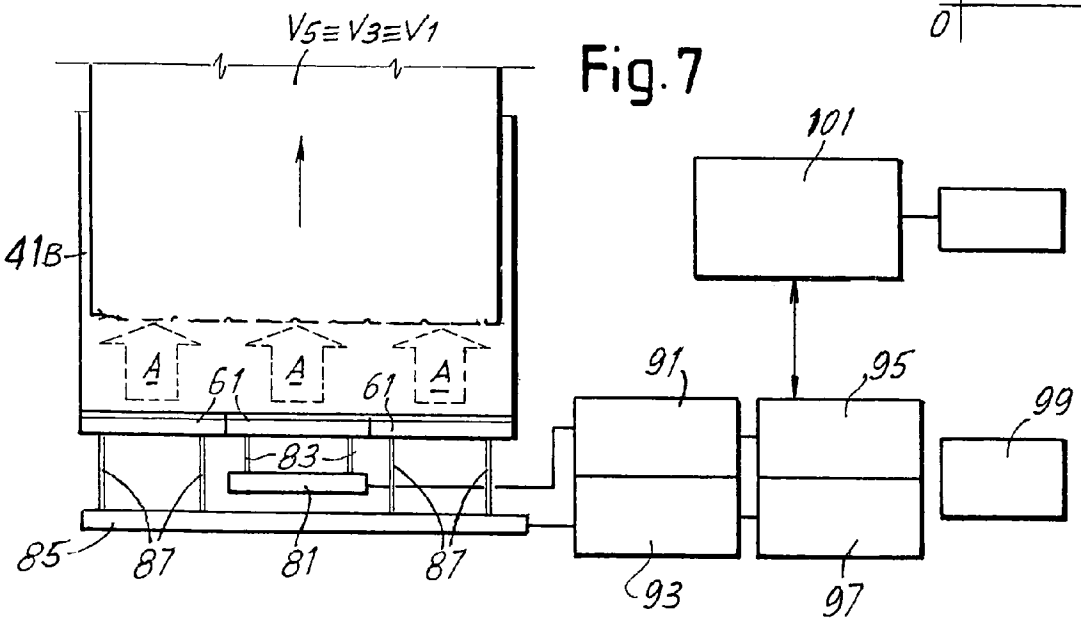
FIG. 7 shows a diagram of the circuit to supply compressed or forced air to a series of laminar nozzles.

In a possible embodiment of the invention, a single laminar nozzle, i.e. with a slot extending transversely with respect to the direction of feed of the web material V1, V3, can be combined with the curved portion of surface with wing-shaped profile 41A. However, according to a preferred embodiment of the invention, schematically shown in FIGS. 7 and 8, along the transverse direction of the device there will be disposed several laminar nozzles 61 or 71 with the compressed air delivery slots 61A or 71A aligned with one another to form in substance a single blade of compressed air. FIG. 7 shows by way of example three laminar nozzles 61 aligned transverse to the machine direction F, which generate distinct and adjacent air flows A. It would also be possible to provide a different number of laminar nozzles 61, preferably greater with respect to the number shown.

In the embodiment shown in FIG. 7, the central nozzle 61 is connected to a compressed air manifold 81 by means of two ducts 83. Each of the lateral laminar nozzles 61 is, conversely, connected to a common manifold 85, by means of ducts 87. The manifolds 81 and 85 are each connected to a respective pressure regulator, indicated with 91 and 93. A pneumatic transducer 95, 97 is respectively connected to each pressure regulator 91, 93. The numeral 99 indicates a compressed air supply line. The pneumatic transducers 95, 97 are interfaced with a control unit 101, which controls the compressed air supply pressure to the nozzles 61 or 71 according to the criteria described in greater detail below.

With this arrangement, it is possible to supply compressed air at different pressures to the central laminar nozzle 61 and to the lateral laminar nozzles 61 respectively. By varying the air pressure inside the manifolds 81 and 85 it is possible to vary the air flow from the corresponding nozzles. By supplying air at a higher pressure to the central nozzle and at a lower pressure to the lateral nozzles, a camber effect is obtained on the plies V1, V3 and V5 (see FIG. 8). This effect facilitates transverse spreading of the plies eliminating creases or in any case reducing the risk of these forming.

Separate control of the laminar nozzles aligned transversely with respect to the direction F of feed of the web material also allows, if necessary, a reduction in the quantity of compressed air consumed if the web material formed by the plies V1, V3 has a smaller width with respect to the maximum width for which the machine is designed. Consequently, this reduces the energy consumption and also the noise generated by the line.

In the embodiment shown in FIGS. 1 to 8 the third ply V5 is fed approximately at the level of the wing-shaped profile defined by the convex curved surface 41A to follow a path that superposes part of the paths of the ply V3 and of the ply V1 coming from the reels B3 and B1 respectively. The possibility of adjusting the rollers with movable axis 19, 29 and 49 separately from one another, which can be combined with the possibility of adjusting the position of the axis of the roller 43 according to the arrow f43, allows the inclinations of the paths of the plies V1, V3 and V5 to be modified separately from one another to obtain the best lift effect on the three plies.

The air supplied from the laminar nozzles 61 or 71 under the ply V1 approximately in the area in which the third ply V5 is fed allows, if necessary, the effect of aerodynamic support to be improved by increasing the air flow between the lower ply V1 and the substantially flat surface 41B with respect to the effect obtainable only as a result of the suction caused by the speed of the ply moving above the convex curved surface 41A.

In actual fact, it is not necessary to supply compressed air continuously through the laminar nozzles 61 or 71. In fact, at high speeds the air drawn as a result of the movement of the ply V1 along the substantially flat surface 41B can be sufficient.

Figure 8A:
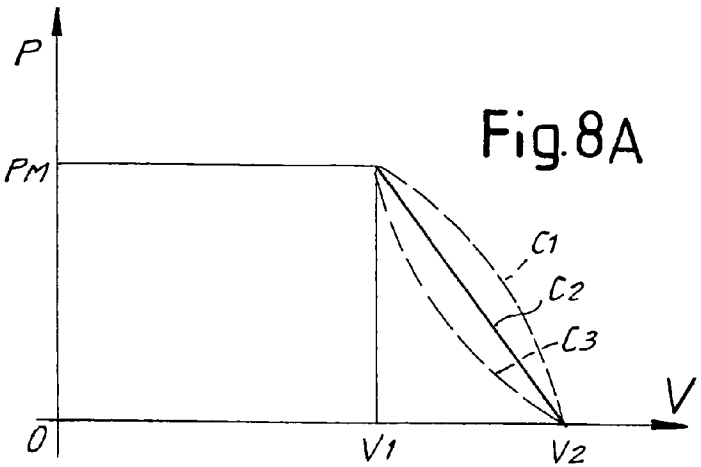
FIG. 8A shows a diagram of the pressure of compressed or forced air supplied from the nozzles as a function of the speed of the plies.
Figure 8:
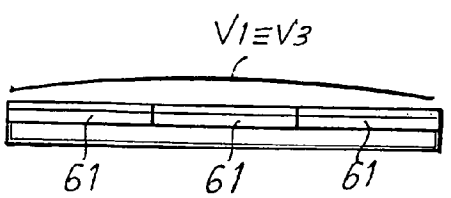
FIG. 8 shows operation of a series of laminar nozzles aligned transversely to adjust the camber of the ply being fed.

FIG. 8A shows an example of a diagram for regulating air pressure through one or more laminar nozzles 61, 71 as a function of the feed speed v of the plies V1, V3 and V5. If, for the reasons indicated above, these plies have different feed speeds, reference can be made to a mean speed. As can be seen in FIG. 8A, the pressure of the air supplied to the manifolds connected to the nozzles 61 and 71 takes a maximum value PM for speed of the plies (mean speed) variable from 0 to v1, where v1 can be a speed indicatively equal to 80 m/min, although the invention is not limited to a particular value of this speed. For speeds increasing from the value v1 to a value v2 (which can be taken by way of non-limiting example as approximately 120 m/min) the pressure of the air supplied to the nozzles 61, 71 is reduced according to a suitable law from the maximum value PM to 0. The diagram indicates three curves C1, C2 and C3 which represent various possible modes of varying the pressure between the speed v1 and the speed v2 of the plies V1, V3, V5. In this case it is assumed that when the plies have a speed equal to or greater than v2, the air drawn by suction as a result of the speed of the plies along the convex curved surfaces 11A and 41A is sufficient to ensure support of the plies. Instead of a mean speed v, the feed speed of the lower ply V1 can be considered as control parameter.

In other words, the compressed air supply from the nozzles 61 or 71 can be limited to the transitory phases, i.e. start-up, or if the feed speed of the plies, for any reason, were to drop below the threshold value v2. In this case the pressure of the air to the nozzles 61 or 71 increases gradually as the speed decreases.

According to a different embodiment, it can be provided that the compressed air flow supplied from the nozzle is never equal to zero, and therefore even at high speeds of the plies a certain flow rate of air is supplied through the nozzles, which is added to the flow rate of air drawn as a result of the speed of the plies.

In the transitory phases, with feed speed v below v2, the feed speed of the web material of the single unwinders 1, 3 and 5 can be controlled substantially at zero tension, i.e. controlling the rotation speed of the reels B1, B3 and B5 so that the load cells 21, 31 and 51 read a zero tension on the plies V1, V3 and V5 respectively. When the speed of the plies exceeds a specific value, which could be the value v1 or preferably the value v2, the unwinding speed of the unwinders 1, 3 and 5 can be controlled on the basis of the tension value detected by the aforesaid load cells, modulating the feed speed to maintain the tension of the single plies at a predetermined value, possibly variable as a function of other process parameters.

In substance, therefore, the device can work in two different modes:

with feed speed above a pre-set minimum the unwinding speed of the unwinders is controlled to maintain the adequate pre-set tension on the single plies and the nozzles 61, 71 are preferably closed, i.e. do not supply compressed air;

for speeds below this pre-set speed the tension control is temporarily deactivated and the rotation speeds of the unwinders are maintained at a value that does not cause tensions in the plies V1, V3, V5, which are made to float efficiently by the air blown through the nozzles 61, 71 disposed at the level of the second wing-shaped profile 41A.

In some cases, and in particular when the plies fed are three or more than three (although it would also be possible to use this solution with only two plies), in addition to the laminar nozzles 61, 71 located under the paths of the plies V1, V3 and V5, it would also be possible to use one or more Coanda effect laminar nozzles arranged above the path of the uppermost ply, in the example shown the ply V5. This possibility is shown schematically in FIGS. 9 and 10, where the same numbers indicate the same or equivalent parts to those of the example of embodiment described above.

Figure 9:
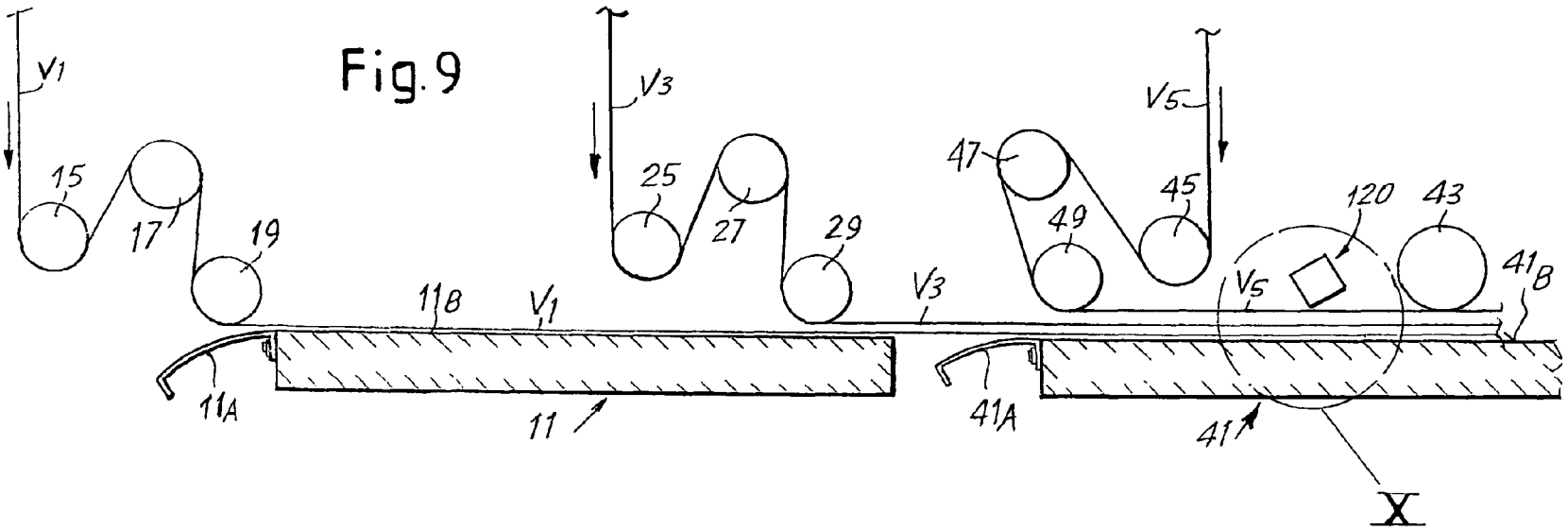
FIG. 9 shows a diagram of a modified embodiment of the path of the plies.
Figure 10:
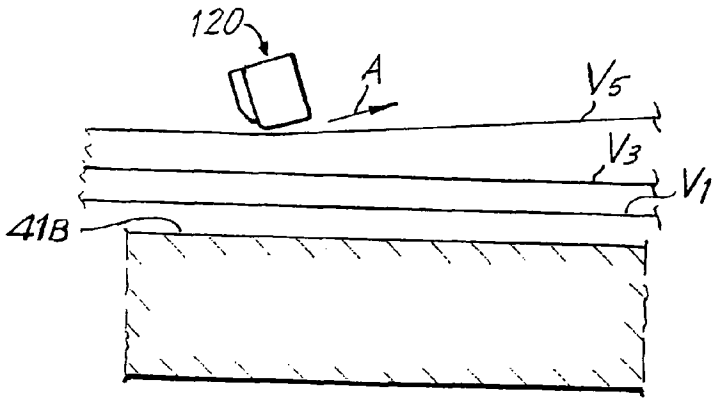
FIG. 10 shows an enlargement of the detail X in FIG. 9.

In the diagram in FIGS. 9 and 10, an arrangement of one or more Coanda effect nozzles 120 is provided. The nozzles 120 can have the same configuration as the nozzles 61, but are oriented so that the air flow A caused by the limited flow rate of compressed air delivered from the slot of the nozzles 120 tends to lift the third ply V5. The curved surface adjacent to the delivery slot of the air is disposed in such a way as to gradually move away from the ply V5 in the direction of movement thereof, starting from a position almost tangent to the ply. The air fed through the slot of the nozzle or nozzles 120 causes a suction of ambient air through the space between the ply and this or these nozzles. Downstream of the slot the air flow adhering to the curved surface of the Coanda nozzle causes a vacuum that tends to lift the ply V5 below.

In substance, with this arrangement a supporting force is generated by the Coanda effect on the upper ply V5, which consequently reduces the weight exerted on the plies below.

In the case of the nozzles 120 it is not necessary to control the supply pressure of the air in a differentiated manner for the various nozzles aligned transversely, but it is useful to supply several points of several nozzles aligned transverse to the direction of feed F of the plies. Moreover, as in the case of supplying the nozzles 61, 71, the air supply can be continuous or limited to the transitory phases, for example when the speed of the plies is below a predetermined value, which may coincide with the value v2 (FIG. 8A) but which could also be a different value with respect thereto.

At the outlet of the device described, upstream of the subsequent station (for example an embossing unit) there can be disposed drawing pressors, preferably in the same number as the number of plies less one (i.e. one pressor roller for a system with two plies). This allows the tension of the plies to be more effectively controlled.

It is understood that the drawing only shows an example provided by way of a practical arrangement of the invention, and that said invention can vary in forms and arrangement without however departing from the scope of the concept underlying the invention. Any reference numbers in the appended claims are provided to facilitate reading of the claims with reference to the description and to the drawing, and do not limit the scope of protection represented by the claims.

What I claim is:

1. A device for feeding plies of web material, comprising:

at least two paths including a first path for a first web material and a second path for a second web material at least partly superposed on each other, the first web material and the second web material being adjacent to each other in an area of superposition;

at least one supporting surface, said supporting surface having an initial curved portion, at least part of said first path and of said second path extending above said supporting surface, said first path being disposed adjacent to said supporting surface, said second path being arranged above said first path, and said initial curved portion having a convexity facing said first path;

at least one air supply system between the first path and said supporting surface, to enhance support of the web material with respect to the supporting surface;

and along each of said first path and said second path, respectively, at least one first guide roller for the first web material and at least one second guide roller for the second web material.

2. The device as claimed in claim 1, wherein said initial curved portion has an aerodynamic profile, which creates suction of air between the supporting surface and the first web material as a result of movement of the first web material with respect to said initial curved portion.

3. The device as claimed in claim 2, wherein said supporting surface has a main substantially flat portion arranged downstream of said initial curved portion and adjacent thereto.

4. The device as claimed in claim 2, wherein said main substantially flat portion is connected to said initial curved portion.

5. The device as claimed in claim 1, wherein said supporting surface has a main substantially flat portion arranged downstream of said initial curved portion and adjacent thereto.

6. The device as claimed in claim 5, wherein said main substantially flat portion is connected to said initial curved portion.

7. The device as claimed in claim 1, further comprising a plurality of each of said first guide roller and said second guide roller.

8. The device as claimed in claim 7, wherein at least one said first guide roller is positioned approximately at a position where said air supply system is arranged.

9. The device as claimed in claim 1, wherein said first guide roller or said second guide roller is adjustable to modify distance of the first path or the second path of the first web material and the second web material, respectively, with respect to the supporting surface.

10. The device as claimed in claim 1, wherein conditions of air flow through said air supply system are regulatable.

11. The device as claimed in claim 10, wherein the conditions of the air flow through said air supply system are regulatable as a function of feed speed of at least one of said first web material and said second web material.

12. The device as claimed in claim 10, wherein said conditions of the air flow through said air supply system are regulatable to increase, reduce or interrupt rate of the air flow.

13. The device as claimed in claim 1, wherein said air supply system comprises at least one laminar nozzle.

14. The device as claimed in claim 13, wherein said at least one laminar nozzle comprises an air delivery slot, combined with at least one inclined surface to generate suction of ambient air as a result of air flow delivered from said slot.

15. The device as claimed in claim 1, wherein said air supply system comprises a plurality of nozzles aligned transverse to a direction of feed of a respective web material.

16. The device as claimed in claim 15, wherein said air supply system comprises a plurality of laminar nozzles with slots aligned along a substantially transverse direction.

17. The device as claimed in claim 15, wherein said nozzles are connected to at least two separate air supply ducts, with separate adjustment of a flow of air to said nozzles.

18. The device as claimed in claim 17, wherein said at least two air supply ducts are associated with respective pressure regulators to regulate pressure of air flow supplied to said nozzles.

19. The device as claimed in claim 18, wherein said supporting surface has a main substantially flat portion arranged downstream of said initial curved portion and adjacent thereto, and wherein said Coanda effect laminar nozzles are arranged approximately between the main substantially flat portion and the initial curved portion.

20. The device as claimed in claim 17, comprising at least one central nozzle and at least two lateral nozzles adjacent to said central nozzle on opposite sides thereof, wherein said at least two lateral nozzles are connected to a first air supply duct and said at least one central nozzle is connected to a second air supply duct.

21. The device as claimed in claim 1, wherein said air supply system comprises a plurality of Coanda effect laminar nozzles, which generate a flow substantially tangent to the supporting surface.

22. The device as claimed in claim 1, wherein at least one of said first path and said second path has a substantially rectilinear portion inclined with respect to the supporting surface, with an angle such that the at least one of said first path and the second path is divergent with respect to the supporting surface in a direction of feed of web material along a respective path.

23. The device as claimed in claim 1, wherein along at least one of said first path and said second path there is provided at least one tension sensor to detect tension of the web material.

24. The device as claimed in claim 23, comprising a tension sensor in each of said first path and said second path.

25. The device as claimed in claim 23, wherein said at least one tension sensor is associated with a respective web material guide roller.

26. The device as claimed in claim 23, wherein said tension sensor is a load cell.

27. The device as claimed in claim 1, wherein said air supply system is controlled so as to supply air when speed of at least one of said first web material and said second web material drops below a first threshold value and to interrupt the air supply when speed of at least one of said first web material and said second web material exceeds a second threshold value.

28. The device as claimed in claim 27, wherein said first threshold value and said second threshold value are different from each other.

29. The device as claimed in claim 1, comprising a speed regulator to regulate feed speed of at least one of said first web material and said second web material, said speed regulator being combined with a tension sensor of a respective one of said first web material or said second web material, and being programmed to control the feed speed of the at least one of said first web material and said second web material so as to maintain tension of at least one of said first web material and said second web material within an interval of values settable around a nominal tension value.

30. The device as claimed in claim 29, wherein said speed regulator is programmed so that when the feed speed of the at least one of said first web material and said second web material drops below a lower limit value, the tension of the at least one of said first web material and said second web material is maintained at a value substantially lower than the nominal tension value.

31. The device as claimed in claim 1, further comprising a plurality of supporting surfaces disposed in succession under said first path of the first web material, said at least one air supply system being associated with at least one of said supporting surfaces.

32. The device as claimed in claim 1, further comprising a third path for a third web material, said first path, said second path and said third path being at least partly superposed.

33. The device as claimed in claim 1, wherein along said supporting surface and thereabove at least one air nozzle is arranged, adjacent to one of said first path and said second path, constructed and arranged so as to generate by air flow delivered therefrom, a lifting effect on web material fed along said first path or said second path.

34. The device as claimed in claim 33, wherein said air nozzle is a Coanda effect nozzle.

35. The device as claimed in claim 33, wherein said air nozzle is positioned downstream of said air supply system.

36. The device as claimed in claim 33, further comprising a plurality of said at least one air nozzle wherein said plurality are aligned with one another transverse to said at least two paths of web material to generate said lifting effect.

37. The device as claimed in claim 36, wherein at least some of said plurality of said at least one air nozzle which generate said lifting effect are controllable separately from one another.

38. The device as claimed in claim 1, wherein at least two web materials are fed at different speeds along each respective path.

39. The device as claimed in claim 1, wherein said initial curved portion is smooth and said substantially flat portion has an embossed surface structure.

40. The device as claimed in claim 39, wherein said embossed surface structure has embossing with a rice grain pattern.

41. A tissue paper converting line, comprising at least one unwinder to unwind reels of web material; at least one converting machine, and at least two paths for at least two web materials between said at least one unwinder and said at least one converting machine, wherein between said at least one unwinder and said at least one converting machine is present a device for feeding plies of web material, comprising:

at least two paths including a first path for a first web material and a second path for a second web material at least partly superposed on each other, the first web material and the second web material being adjacent to each other in an area of superposition;

at least one supporting surface, said supporting surface having an initial curved portion, at least part of said first path and of said second path extending above said supporting surface, said first path being disposed adjacent to said supporting surface, said second path being arranged above said first path, and said initial curved portion having a convexity facing said first path;

at least one air supply system between the first path and said supporting surface, to enhance support of the web material with respect to the supporting surface;

and along each of said first path and said second path, respectively, at least one first guide roller for the first web material and at least one second guide roller for the second web material.

42. The converting line as claimed in claim 41, comprising at least two unwinders in sequence, to simultaneously unwind two reels of web material, to feed said first web material and said second web material along said first path and said second path respectively.

* * * * *

UNITED STATES PATENT AND TRADEMARK OFFICE

CERTIFICATE OF CORRECTION

PATENT NO. : 7,938,355 B2
APPLICATION NO. : 11/889248
DATED : May 10, 2011
INVENTOR(S) : Angelo Benvenuti It is certified that error appears in the above-identified patent and that said Letters Patent is hereby corrected as shown below:

Column 11:
Claim 4, Line 1, “claim 2” should read -- claim 3 --.

Column 13:
Claim 41, Line 15, “material;” should read -- material, --.

Signed and Sealed this
Twenty-fourth Day of April, 2012

David J. Kappos

David J. Kappos
*Director of the United States Patent and Trademark Office*